US011331541B2

(12) United States Patent
Kim

(10) Patent No.: US 11,331,541 B2
(45) Date of Patent: May 17, 2022

(54) SWIMMING ASSISTANCE APPARATUS

(71) Applicant: Jeong Hun Kim, Seoul (KR)

(72) Inventor: Jeong Hun Kim, Seoul (KR)

( * ) Notice: Subject to any disclaimer, the term of this patent is extended or adjusted under 35 U.S.C. 154(b) by 26 days.

(21) Appl. No.: 16/999,053

(22) Filed: Aug. 20, 2020

(65) Prior Publication Data

US 2020/0376344 A1 Dec. 3, 2020

Related U.S. Application Data

(63) Continuation of application No. 16/289,546, filed on Feb. 28, 2019, now abandoned, which is a (Continued)

(30) Foreign Application Priority Data

Jul. 4, 2013 (KR) ..... 10-2013-0078586
Mar. 18, 2014 (KR) ..... 10-2014-0031825

(51) Int. Cl.

| | |
|---|---|
| ***A63B 31/12*** | (2006.01) |
| ***A63B 69/14*** | (2006.01) |
| ***A63B 35/02*** | (2006.01) |
| ***A63B 31/11*** | (2006.01) |
| ***A63B 71/00*** | (2006.01) |

(52) U.S. Cl.

CPC ..... *A63B 31/12* (2013.01); *A63B 31/11* (2013.01); *A63B 35/02* (2013.01); *A63B 69/14* (2013.01); *A63B 71/0009* (2013.01); *A63B 2208/03* (2013.01); *A63B 2209/08* (2013.01); (Continued)

(58) Field of Classification Search

CPC . A63B 2208/03; A63B 2209/08; A63B 69/12; A63B 31/00; A63B 69/14; A63B 2244/20; A63B 31/08; A63B 31/10; A63B 31/11; A63B 31/12; A63B 31/14; A63B 35/00; A63B 35/02; A63B 21/4011; (Continued)

(56) References Cited

U.S. PATENT DOCUMENTS 2,295,906 A 9/1942 Lacour
2,536,390 A 1/1951 Pobochenko
(Continued)

FOREIGN PATENT DOCUMENTS

CN 301592190 S 6/2011
CN 203507444 U 4/2014
(Continued)

OTHER PUBLICATIONS

KR Grant of Patent dated Sep. 27, 2013 as recived in Application No. 10-2013-0078586.
(Continued)

*Primary Examiner* — Daniel V Venne
(74) *Attorney, Agent, or Firm* — Nicholas Park

(57) ABSTRACT

Disclosed is a swimming assistance apparatus, which is worn on a user's both feet to provide the user with buoyancy, such that the user can float on water and swim in a good swimming style while repeatedly moving the waist from side to side like a fish, thereby reinforcing the user's waist muscles. Persons who have knee joint arthralgia or backache or persons who have disability in the lower body can use the swimming assistance apparatus for medical purposes, such as pain relief or treatment.

18 Claims, 14 Drawing Sheets

Related U.S. Application Data continuation of application No. 15/457,902, filed on Mar. 13, 2017, now abandoned, which is a continuation of application No. 14/436,298, filed as application No. PCT/KR2014/005833 on Jul. 1, 2014, now abandoned.

(52) U.S. Cl.
CPC ..... *A63B 2209/10* (2013.01); *A63B 2225/01* (2013.01); *A63B 2225/62* (2013.01)

(58) Field of Classification Search
CPC ... A63B 21/4013; A63B 21/4015; B63C 9/13; B63C 9/135; B63C 2009/13
USPC ..... 441/55, 60, 61–63, 88, 125, 129, 132, 441/136
See application file for complete search history.

(56) References Cited

U.S. PATENT DOCUMENTS

| | | | | |
|---|---|---|---|---|
| 2,748,401 | A | 6/1956 | Winstead | |
| 3,528,116 | A | 9/1970 | Fenar | |
| 3,604,023 | A | 9/1971 | Lynch | |
| 3,771,181 | A | 11/1973 | Dansereau | |
| 4,090,268 | A | 5/1978 | Turner | |
| 4,362,518 | A | 12/1982 | Boissière | |
| 4,379,704 | A | 4/1983 | Rademacher | |
| D284,436 | S | 7/1986 | Hodges | |
| 4,747,779 | A | 5/1988 | Gerstung | |
| 4,929,205 | A | 5/1990 | Jones | |
| 4,936,804 | A | 6/1990 | Dowdeswell | |
| 5,015,208 | A | 5/1991 | Fox et al. | |
| 5,055,075 | A | 10/1991 | Waller, Jr. | |
| 5,344,373 | A | 9/1994 | Geerne | |
| 5,389,058 | A | 2/1995 | Tinari | |
| 5,443,409 | A | 8/1995 | Adamson | |
| 5,530,980 | A | 7/1996 | Sommerhalter, Jr. | |
| 5,571,050 | A | 11/1996 | Huang | |
| 5,628,714 | A | 5/1997 | Philipson | |
| 5,700,173 | A | 12/1997 | Lerro | |
| 5,746,218 | A | 5/1998 | Edge | |
| 5,749,759 | A | 5/1998 | Hooper | |
| D422,331 | S | 4/2000 | Ponce De Leon | |
| 6,083,067 | A | 7/2000 | McCredie | |
| 6,154,905 | A | 12/2000 | Frydman | |
| 6,182,314 | B1 | 2/2001 | Frydman | |
| D447,568 | S | 9/2001 | Hall et al. | |
| 6,490,742 | B2 | 12/2002 | Hall et al. | |
| 6,764,362 | B1 | 7/2004 | Wenzel | |
| 6,793,549 | B1 | 9/2004 | Chiang | |
| 7,169,000 | B1 * | 1/2007 | Hernandez | A63B 31/12 441/60 |
| D579,706 | S | 11/2008 | Cox et al. | |
| 7,677,939 | B2 | 3/2010 | Dahl | |
| D690,535 | S | 10/2013 | Huang | |
| D706,372 | S | 6/2014 | Day | |
| D732,131 | S | 6/2015 | DiLorenzo et al. | |
| 9,259,632 | B2 * | 2/2016 | DiLorenzo | A63B 23/02 |
| 9,278,257 | B2 | 3/2016 | Kacar | |
| 2009/0075537 | A1 | 3/2009 | Devers | |
| 2013/0034381 | A1 | 2/2013 | McDonald et al. | |
| 2013/0344756 | A1 | 12/2013 | Day | |
| 2014/0030940 | A1 | 1/2014 | Day | |
| 2015/0259055 | A1 | 9/2015 | Nakamoto | |

FOREIGN PATENT DOCUMENTS

| | | | |
|---|---|---|---|
| JP | S55-8531 | U | 1/1980 |
| JP | 1995-044024 | U | 10/1995 |
| JP | 3100321 | U | 5/2004 |
| JP | 4109706 | B1 | 7/2008 |
| JP | 3150557 | U | 5/2009 |
| JP | 2012-239852 | A | 12/2012 |
| KR | 1987-0003985 | Y1 | 12/1987 |
| KR | 30-0226433 | S | 8/1998 |
| KR | 10-2003-0039397 | A | 5/2003 |
| KR | 20-0394462 | Y1 | 9/2005 |
| KR | 20-0398371 | Y1 | 10/2005 |
| KR | 20-0437315 | Y1 | 11/2007 |
| KR | 30-0495681 | S | 6/2008 |
| KR | 30-0550944 | S | 1/2010 |
| KR | 20-2010-0012957 | U | 12/2010 |
| KR | 10-1150897 | B1 | 5/2012 |
| KR | 30-0655762 | S | 8/2012 |
| KR | 20-0465876 | Y1 | 3/2013 |
| KR | 10-1323112 | B1 | 11/2013 |

OTHER PUBLICATIONS

KR Office Action dated Aug. 8, 2013 as received in Application No. 10-2013-0078586.

Tyr, "Hydrofoil Ankle Float", Accessed and Screen shots created on Dec. 3, 2015, <http://www.tyr.com/shop/tyr-hydrofoil-ankle-float.html>.

* cited by examiner

SWIMMING ASSISTANCE APPARATUS

CROSS-REFERENCE TO RELATED APPLICATIONS

This application is a continuation of U.S. application Ser. No. 16/289,546, filed on Feb. 28, 2019, now abandoned, which is a continuation of U.S. application Ser. No. 15/457,902, filed on Mar. 13, 2017, now abandoned, which is a continuation of U.S. application Ser. No. 14/436,298, filed on Apr. 16, 2015, which is the National Stage filing under 35 U.S.C. 371 of International Application No. PCT/KR2014/005833, filed on Jul. 1, 2014, which claims the benefit of earlier filing date and right of priority to Korean Application Nos. 10-2014-0031825, filed on Mar. 18, 2014 and 10-2013-0078586 filed on Jul. 4, 2013, the contents both of which are all incorporated by references herein in their entireties.

FIELD OF THE INVENTION

The present invention relates to a swimming assistance apparatus. More particularly, the present invention relates to a swimming assistance apparatus which supplies buoyancy to a part of a user's body under water to aid the user to correct a swimming posture or to concentrate on reinforcement of upper body muscles and waist muscles. Moreover, the present invention relates to a swimming assistance apparatus which can relieve and treat symptoms, such as lumbar herniated intervertebral disc or scoliosis.

BACKGROUND OF THE INVENTION

Swimming is one of whole body exercises to improve lung capacity or endurance and reinforce the whole body. Therefore, swimming is being spotlighted as popular life sports all over the worlds, such as Korea, United States, Europe, Australia, Japan, China, and so on.

There are conventional swimming assistance apparatuses, such 20 as swim tubes, floats, boards, and the likes. The swim tube is formed in a doughnut shape. A user can wear the swim tube to surround the waist or to support the user's upper body by covering a part of the swim tube with the hand. The float is formed in a ball which has a hand-grip. The user holds the hand-grip of the float to receive buoyancy. The board is formed in a plate type. The user holds the board to receive buoyancy.

SUMMARY OF THE INVENTION

Technical Problem

However, the conventional swimming assistance apparatuses, such as the swim tubes, the floats and the boards, have a disadvantage in that the user has to hold them with the hand when the user swims. Therefore, the conventional swimming assistance apparatuses interrupt the user's arm movements. Accordingly, the user cannot take a perfect swimming posture in case that the user uses such swimming assistance apparatuses.

Moreover, the conventional swimming assistance apparatuses are easily separated from the user's hand, and hence, swimming beginners may let the swimming assistance apparatus slip through the user's hand. Such an experience may give evasion of swimming or resistance to swimming to the swimming beginner, and it may be trauma in the swimming beginner's head for a long time.

Furthermore, the conventional swimming assistance apparatuses have another disadvantage in that the user has to always make muscle of the arm tense when using the swimming assistance apparatuses. So, the user tires easily and cannot gain confidence of swimming. Additionally, because muscles are tense, it is difficult to correct the swimming posture smoothly.

In addition, the floats and the boards of the conventional swimming assistance apparatuses has a disadvantage in that the user can train only whip kick, because the user moves forward by whip kick in a state where the user holds the float or the board with both hands and keeps the user's arms and body straight.

Moreover, a vest type float of the conventional swimming assistance apparatuses has a disadvantage in that there is a limit in swimming styles and it is difficult to take a swimming posture under water, because the user floats vertically under water by the vest type float.

Furthermore, swimming styles which can be carried out when the user uses the conventional swimming assistance apparatuses are very limited. In general, when the user uses the conventional swimming assistance apparatuses, the user can show just the swimming style to move the waist up and down. Such a swimming style increases backache of patients who suffer from backache by lumbar herniated intervertebral disc.

Additionally, it is impossible for persons who have disability in the lower body, such as paraplegia, to do whip kick or move the waist up and down while swimming, and the persons who have disability in the lower body go under water in a state where the legs are drifted open when they enter the water. Therefore, the persons who have disability in the lower body cannot use the conventional swimming assistance apparatuses.

Not only the persons who have disability in the lower body but also general teenagers and adults with normal body functions, who have scoliosis generated when the persons study or work sitting in chairs for a long time, it is hard to correct the twisted pelvis or treat scoliosis through swimming.

Accordingly, the present invention has been made in an effort to solve the above-mentioned problems occurring in the prior arts. It is an object of the present invention to provide a swimming assistance apparatus which is worn on a use's feet to make the user float on water by buoyancy and to make the user swim in the swimming style like fish swimming to repeatedly move the waist from side to side, thereby correcting the swimming posture or concentrating on reinforcement of upper body muscles and waist muscles.

It is another object of the present invention to provide a swimming assistance apparatus which makes the user swim while moving the waist from side to side repeatedly, thereby relieving or treating pains of patients who suffer from knee joint pain or backache or persons who have disability in the lower body.

Technical Solution

To achieve the above objects, the present invention provides a swimming assistance apparatus. The swimming assistance apparatus includes a body made of a material which floats on water or formed in a hollow tube type which floats on water, a fitting hole formed in a hollow cylinder shape and penetrating through the body to surround a part of a user's lower body, and a cut part formed in the wall of one side of the fitting hole in such a way that a part of the user's lower body can be inserted into the fitting hole. When the user swims in a state where the user's lower body is inserted into the fitting hole, the user's lower body floats on water by buoyancy of the body.

Moreover, a part of the user's lower body inserted into the fitting hole may be the ankle or the calf.

Furthermore, the fitting hole may include a first fitting hole and a second fitting hole configured in such a manner that the user can insert the right and left legs into the first and second fitting holes respectively, and the user's legs are collected and fixed by the first and second fitting holes.

Additionally, the fitting hole may include a first fitting hole and a second fitting hole configured in such a manner that the user can insert the right and left legs into the first and second fitting holes respectively. The body is configured to be divided between the first and second fitting holes. The swimming assistance apparatus further includes detachable fixing means formed on each inner face of the divided body. The detachable fixing means is one of hood and loop fasteners, magnets, buttons, male and female coupling parts, hooks and zippers which can attach and detach the first and second fitting holes.

In addition, the cut part may be formed in the outer wall of the fitting hole in the longitudinal direction of the fitting hole to enable the user to easily insert the user's lower body.

Moreover, the fitting hole may include a first fitting hole and a second fitting hole configured in such a manner that the user can insert the right and left legs into the first and second fitting holes respectively. The cut part may include at least one of a first cut part formed in once side wall of the first fitting hold and a second cut part formed in one of the second fitting hole. At least one among the first and second cut parts may be formed in the upper side wall of the first fitting hole and the second fitting hole to enable the user to easily put the user's lower body thereon.

Furthermore, the fitting hole may include a first fitting hole and a second fitting hole configured in such a manner that the user can insert the right and left legs into the first and second fitting holes respectively. The cut part may include first and second cut parts respectively formed in the side walls of the first and second fitting holes. The first cut part is formed in the upper side wall of the first fitting hole and the second cut part is formed in the lower side wall of the second fitting hole.

Additionally, the swimming assistance apparatus further includes a plurality of protrusion parts formed on the inner face of the fitting hole in the diameter direction and extend in the longitudinal direction of the fitting hole so as to provide the user's lower body with comfort and enhance fixation power of the user's lower body.

In addition, the swimming assistance apparatus further includes a plurality of protrusion parts formed on the inner face of the fitting hole in the diameter direction and are formed in a spherical shape so as to provide the user's lower body with comfort and enhance fixation power of the user's lower body.

Moreover, the swimming assistance apparatus further includes a plurality of protrusion parts formed on the inner face of the fitting hole in the diameter direction and extend spirally in the longitudinal direction of the fitting hole so as to provide the user's lower body with comfort and enhance fixation power of the user's lower body.

Furthermore, the swimming assistance apparatus further includes at least one among: wings formed at both sides of the body in the longitudinal direction and have a predetermined curvature at the front face, which is the user's advancing direction, in order to reduce underwater resistance, and at least one of fins which vertically protrude from the upper side and the lower side of the middle part of the body and have a predetermined curvature at the front face, which is the user's advancing direction, in order to reduce underwater resistance, thereby offsetting a rotational force around the user's advancing direction.

Additionally, the body may be formed in a flat board type and the fitting hole may be formed to get in contact with one side of the body. The swimming assistance apparatus further includes wings formed at both sides of the body in the longitudinal direction and have a predetermined curvature at the front face, which is the user's advancing direction, in order to reduce underwater resistance.

In addition, the fitting hole may include a first fitting hole and a second fitting hole configured in such a manner that the user can insert the right and left legs into the first and second fitting holes respectively. The swimming assistance apparatus further includes a through hole formed in the body and penetrating through the inside of the body between the first fitting hole and the second fitting hole, so as to reduce underwater resistance generated in the user's advancing direction.

Moreover, the swimming assistance apparatus further includes at least one hand-grip depressed in one side of the body or penetrates through the body, such that the user can insert at least one finger into the hand-grip to grasp the body.

Furthermore, the swimming assistance apparatus further includes at least one among: wings formed at both sides of the body in the longitudinal direction and have a predetermined curvature a the front face, which is the user's advancing direction, in order to reduce underwater resistance, and at least one of fins which vertically protrude from the upper side and the lower side of the middle part of the body and have a predetermined curvature at the front face, which is the user's advancing direction, in order to reduce underwater resistance, thereby offsetting a rotational force around the user's advancing direction. The swimming assistance apparatus further includes at least one hand-grip depressed in one side of the wing or the fin or penetrates through the wing or the fin, such that the user can insert at least one finger into the hand-grip to grasp the body.

Additionally, the swimming assistance apparatus further includes a plate type partition wall formed inside the hollow body for maintaining the form of the body and relieving distortion of the body.

In addition, the swimming assistance apparatus further includes a plurality of plate type partition walls formed inside the hollow body for maintaining the form of the body and relieving distortion of the body. The plurality of partition walls cross each other.

Moreover, the swimming assistance apparatus further includes a plurality of plate type partition walls formed inside the hollow body for maintaining the form of the body and relieving distortion of the body. The plurality of partition walls are connected with one another in a honey comb shape.

Furthermore, the swimming assistance apparatus further includes separation preventing means disposed at one side of the cut part to close the cut part and prevents the inserted user's lower body from being separated from the cut part.

Additionally, the separation preventing means may be one of hook and loop fasteners, magnets, buttons, male and female coupling parts, hooks and zippers.

In addition, the fitting hole may include a first fitting hole and a second fitting hole configured in such a manner that the user can insert the right and left legs into the first and second fitting holes respectively. The swimming assistance apparatus further includes a depressed part inwardly depressed to a specific depth between the first fitting hole and the second fitting hole of the body, such that the user inserts and fixes a part of the user's lower body into the first fitting hole and the second fitting hole or compresses and fixes a part of the user's lower body to the depressed part.

As described above, the swimming assistance apparatus according to the embodiments of the present invention has the following effects.

First, the swimming assistance apparatus according to the embodiments of the present invention makes the swimming beginners to concentrate on arm movements or the swimming style to move the waist from side to side.

Second, the swimming assistance apparatus according to the embodiments of the present invention can relieve or treat pains of the patients who suffer from knee joint pain or backache or the persons who have disability in the lower body.

Third, the swimming assistance apparatus according to the embodiments of the present invention can give great help to rehabilitation and enhance swimming skills by training upper body muscles and waist muscles because the user can move the waist from side to side.

BRIEF DESCRIPTION OF THE DRAWINGS

The following drawings attached to the description of the present invention are to illustrate embodiments of the present invention and for a more complete understanding of the detailed description and technical idea of the present invention.

Therefore, it will be understood by those of ordinary skill in the art that the present invention is not limited to the matters described or illustrated in the attached drawings.

DETAILED DESCRIPTION OF THE PREFERRED EMBODIMENT

Figure 1:
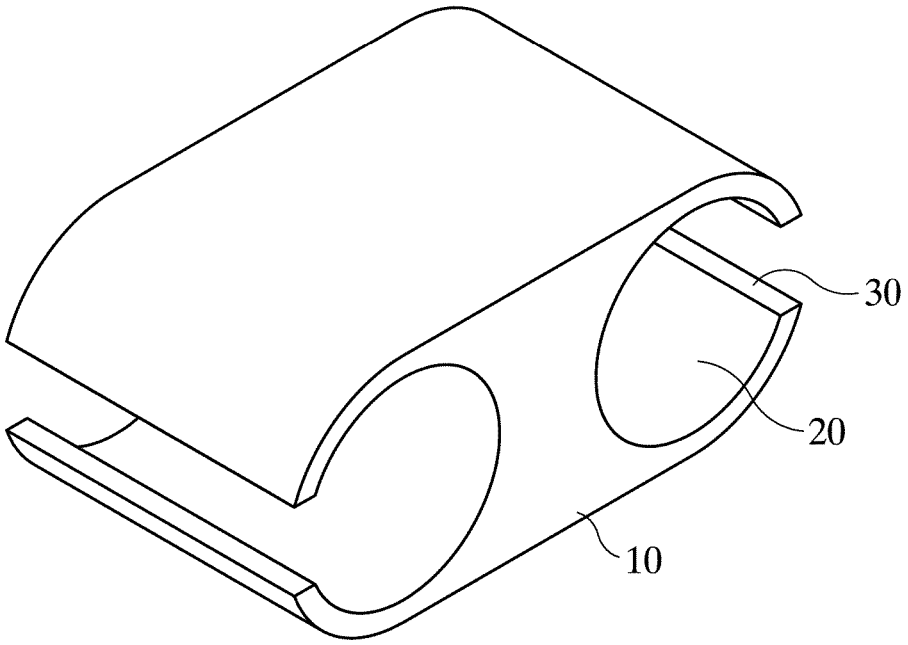
FIG. 1 is a perspective view of a swimming assistance apparatus according to a first embodiment of the present invention.

Reference will be now made in detail to the embodiments of the present invention with reference to the attached drawings. In the description of the present invention, when it is judged that detailed descriptions of known functions or structures related with the present invention may make the essential points vague, the detailed descriptions of the known functions or structures will be omitted.

Moreover, in the drawings, parts having similar functions and actions have the same reference numerals. In the description of the present invention, to connect some part with another part means that some part is directly connected with another part and that some part is indirectly connected with another part through an element. Furthermore, unless otherwise defined herein, to include a component does not mean that the mortise lock excludes other component but means that the mortise lock can include other components more.

Embodiment 1

In relation with the basic structure of a swimming assistance apparatus, the first embodiment of the present invention will be described. FIG. 1 is a perspective view of a swimming assistance apparatus according to a first embodiment of the present invention. As shown in FIG. 1, the swimming assistance apparatus according to the embodiment of the present invention may include a body 10, a fitting hole 20 and a cut part 30.

The body 10 may be made of a material which floats on water or be formed in a hollow tube type which floats on water. The material for the body 10 may be a resin material, for instance, compressed polystyrene foam. The body 10 is basically, formed in a shape of an elliptic cylinder, and may be formed in various shapes as described hereinafter.

The body 10 provides a user's lower body with buoyancy. Buoyancy of the body 10 is determined by volume of the body 10 which is submerged in water and density of the body 10. If volume of the body 10 submerged in water is large and density of the body 10 is small, buoyancy becomes stronger.

The fitting hole 20 is formed in a hollow cylinder shape and penetrates through the body 10. Just one fitting hole 20 may be formed in such a way that the user's both ankles are inserted and fixed into the fitting hole and are surrounded by the swimming assistance apparatus. Alternatively, two fitting holes 20 may be formed in such a way that the user's right ankle and left ankle are respectively inserted and fixed into the fitting holes 20 and are surrounded by the swimming assistance apparatus. In a case that the two fitting holes 20 are formed, the fitting hole to which the left ankle is inserted and fixed is defined as a first fitting hole, and the fitting hole to which the right ankle is inserted and fixed is defined as a second fitting hole.

The fitting hole 20 may have different sizes according to the user's body conditions. For instance, the size of the fitting hole 30 is varied according to age or gender of the users.

The fitting hole 20 can collect the user's legs within a distance that the user does not feel inconvenience. That is, the first fitting hole and the second fitting hole may be formed to have a specific distance from each other. The user's legs are fixed by the fitting hole 20. The user who is fixed in legs can concentrate on the upper body's movements while swimming, reinforce upper body muscles and waist muscles, and especially, show the swimming style to move the waist from side to side. Moreover, persons who have disability in the lower body can enjoy swimming. Furthermore, the problem that swimming beginners cannot concentrate on the upper body posture because splashing water with the feet, which is the swimming beginners' typical problem, can be solved.

The cut part 30 is formed at one side of the fitting hole 20 to make the user's lower body be inserted into the fitting hole 20 easily. Preferably, the cut direction of the cut part 30 is formed in the longitudinal direction of the fitting hole 20. The cut part 30 may be formed at both sides of the longitudinal direction of the body 10, namely, at upper and lower sides of the fitting hole 20.

The cut part 30 makes the user easily insert the legs into the fitting hole 20. Due to the cut part 30 formed in the longitudinal direction of the fitting hole 20 in the embodiment of the present invention, the user's legs are not easily separated from each other under water, and the user can take the legs out of the fitting hole 20 if the user puts his or her mind to it in an emergency situation. Finally, the cut part 30 increases the utility of the swimming assistance apparatus but decreases dangerousness. According to the first embodiment of the present invention, the cut part 30 is formed at right and left sides of the fitting hole 20. However, if the user does not try to take the legs out of the fitting hole 20, the user's legs are not separated from the fitting hole 20 because power is applied to the inside of both legs when the user is swimming.

The cut part 30 may be formed in at least one among the first fitting hole and the second fitting hole. That is, there is no need to form the cut part 30 in both fitting holes 20. Even though the cut part 30 is formed only in one fitting hole 20, the object of the present invention can be achieved.

In a case that the body 10 is made of a synthetic resin material with elasticity, the cut part 30 is widened when the user inserts the user's lower part into the fitting hole 20 and is returned to its initial width when the user's lower part is completely inserted into the fitting hole 20.

The swimming assistance apparatus according to the embodiment of the present invention has not only the first embodiment but also other various embodiments which will be described later.

Embodiment 2

Figure 2:
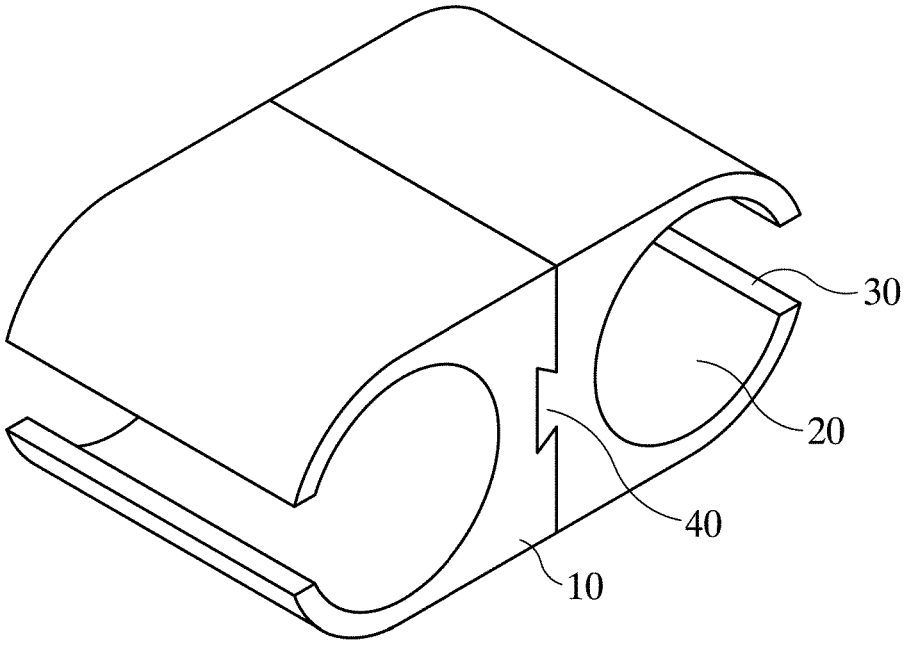
FIG. 2 is a perspective view of a swimming assistance apparatus according to a second embodiment of the present invention.
Figure 3:
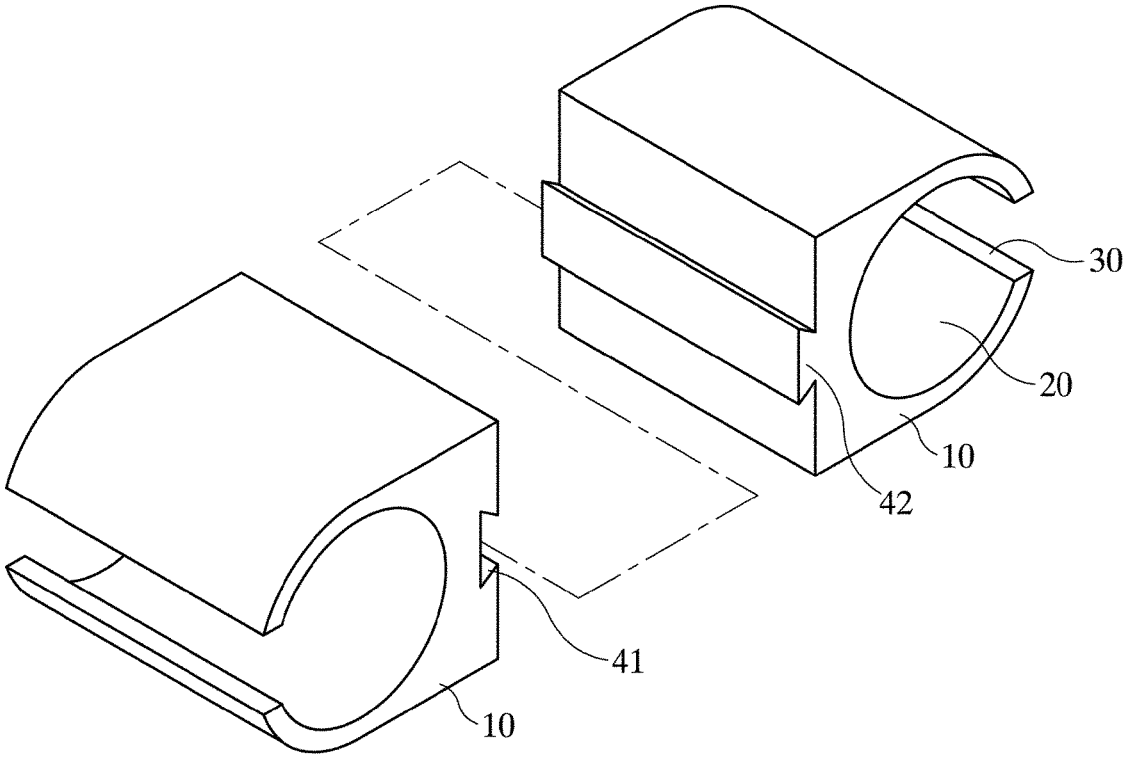
FIG. 3 is an exploded view of a swimming assistance apparatus according to the second embodiment of the present invention.

In connection with the second embodiment of the present invention. FIG. 2 is a perspective view of a swimming assistance apparatus according to the second embodiment of the present invention, and FIG. 3 is an exploded view of a swimming assistance apparatus according to the second embodiment of the present invention. As shown in FIGS. 2 and 2, the swimming assistance apparatus according to the second embodiment of the present invention may include a male and female coupling part 40, which is detachable fixing means configured to divide the body 10 in half and separate the fitting holed 20 from each other.

The swimming assistance apparatus according to the second embodiment of the present invention enhances convenience in wearing. The user wears the swimming assistance apparatus by each leg and inserts a male coupling part 42 into the female coupling part 41. Moreover, a magnet may be mounted on the male and female coupling part 40. Alternatively, instead of the male and female coupling part 40, as the detachable fixing means, hook and loop fasteners, snap fasteners, magnets, hooks, or zippers or combinations of the hook and loop fasteners, the snap fasteners, the magnets, the hooks and the zippers may be disposed on the inner faces of the divided body 10.

Figure 4:
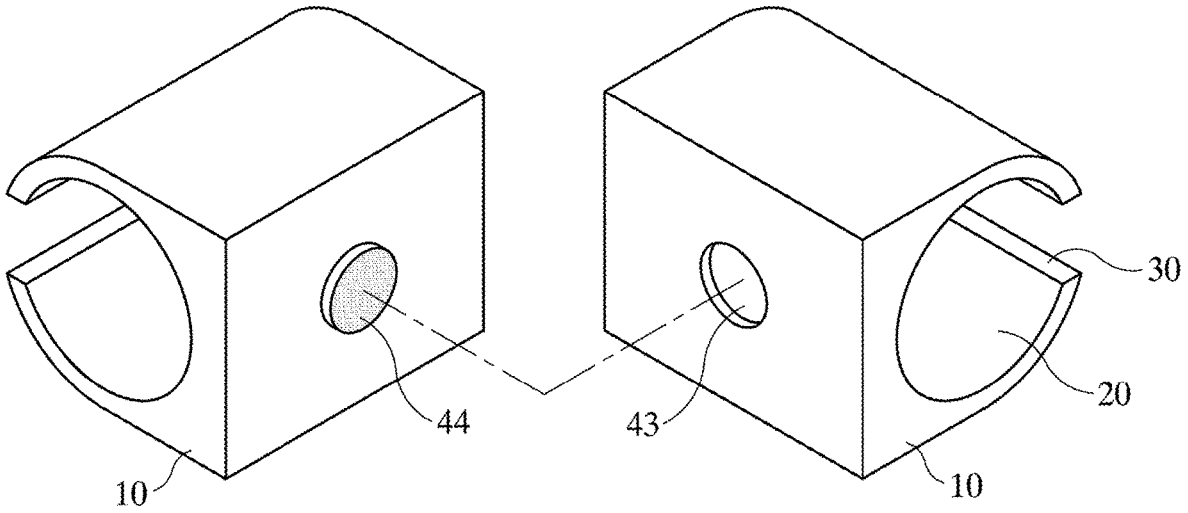
FIG. 4 is a perspective view of a swimming assistance apparatus according to a modification of the second embodiment of the present invention.

FIG. 4 is a perspective view of a swimming assistance apparatus according to a modification of the second embodiment of the present invention. As shown in FIG. 4, the swimming assistance apparatus according to the modification of the second embodiment of the present invention is identical with the swimming assistance apparatus according to the second embodiment of the present invention in that the body is divided in half. As the modification of the second embodiment, the detachable fixing means configured in such a manner that the fitting holes 20 are separated from each other may be round magnets which are coupled in male and female coupling.

Embodiment 3

Figure 5:
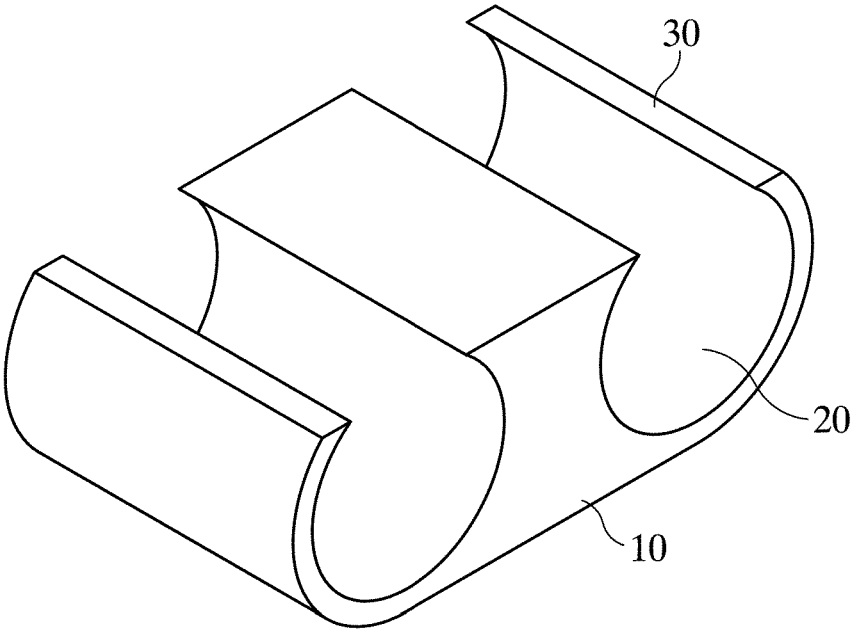
FIG. 5 is a perspective view of a swimming assistance apparatus according to a third embodiment of the present invention.

In connection with the third embodiment of the present invention, FIG. 5 is a perspective view of a swimming assistance apparatus according to the third embodiment of the present invention. As shown in FIG. 5, the swimming assistance apparatus according to the third embodiment of the present invention may include the cut part 30 formed at an upper side of the fitting hole 20.

According to the third embodiment of the present invention, a lower side of the fitting hole 20 comes into contact with the user's leg by buoyancy of the body 10, such that the fitting hole is not easily separated from the user's leg under water. At the same time, when the user lifts the leg upwardly from the fitting hole 20, the leg can be easily separated from the fitting hole 20, and hence, the user can attach and detach the swimming assistance apparatus under an emergent situation if the user puts the user's mind to it.

Embodiment 4

Figure 6:
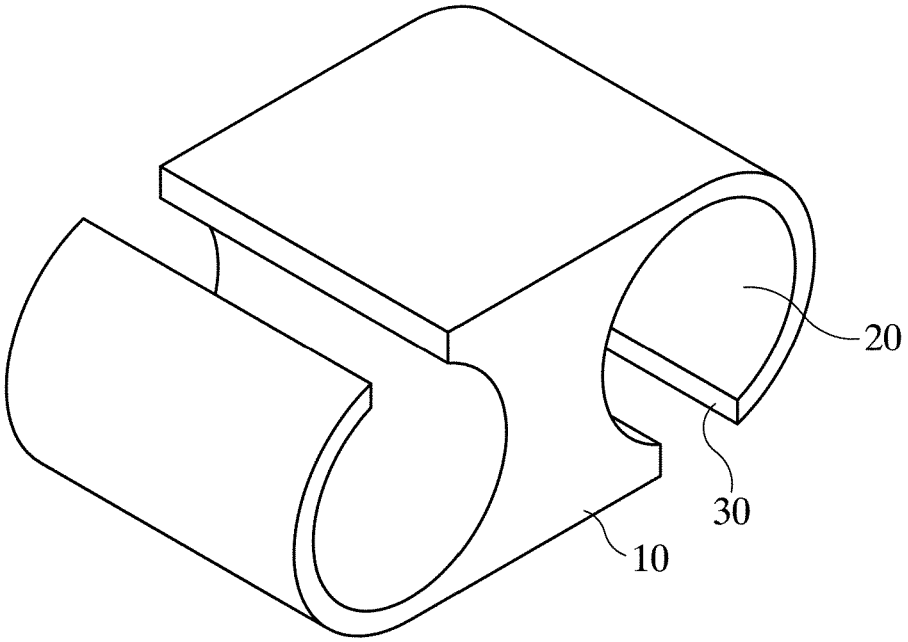
FIG. 6 is a perspective view of a swimming assistance apparatus according to a fourth embodiment of the present invention.

In connection with the fourth embodiment of the present invention, FIG. 6 is a perspective view of a swimming assistance apparatus according to the fourth embodiment of the present invention. As shown in FIG. 6, the swimming assistance apparatus according to the fourth embodiment of the present invention may include the cut parts 30 which are formed in the first fitting hole and the second fitting hole cornerwise. For instance, the cut part 30 is formed at an upper side of the first fitting hole, and the other cut part 30 is formed at a lower side of the second fitting hole. Alternatively, the cut part 30 is formed at an upper side of the first fitting hole, and the other cut part 30 is formed at a right or left side of the second fitting hole.

The swimming assistance apparatus according to the fourth embodiment of the present invention can provide various effects according to positions of the cut parts 30. For instance, when the cut part 30 is formed at an upper side of the first fitting hole 20, because the lower side of the fitting hole 20 comes into contact with the user's leg under water by buoyancy of the body 10, the swimming assistance apparatus is not easily separated from the user's leg under water but the user can easily take the legs from the fitting holes 20 by lifting the legs upwardly from the fitting holes 20, and hence, the user can attach and detach the swimming assistance apparatus under an emergent situation if the user puts the user's mind to it.

Embodiment 5

Figure 7:
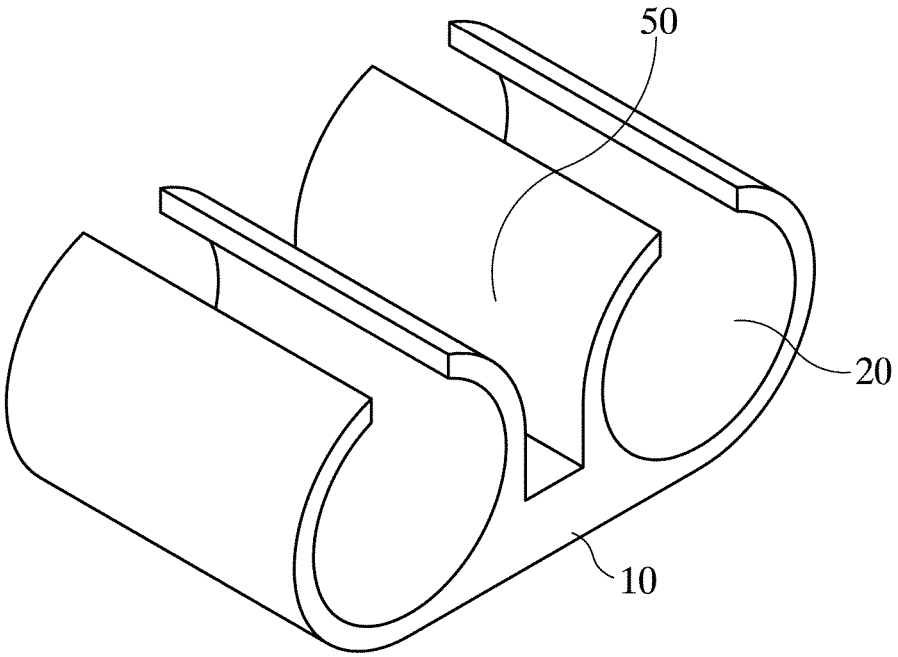
FIG. 7 is a perspective view of a swimming assistance apparatus according to a fifth embodiment of the present invention.

In connection with the fifth embodiment of the present invention, FIG. 7 is a perspective view of a swimming assistance apparatus according to the fifth embodiment of the present invention. As shown in FIG. 7, the swimming assistance apparatus according to the fifth embodiment of the present invention may include a depressed part 50 which is transversely depressed in the middle of the body 10. The depressed part 50 may be formed from the upper side to the lower side of the body 10 or from the lower side to the upper side of the body 10. Moreover, the depressed part 50 may be formed from the upper and lower sides toward the inside of the body 10. Furthermore, the depressed part 50 may be formed inwardly from the back and forth direction.

According to the fifth embodiment of the present invention, the depressed part 50 decreases manufacturing costs of the swimming assistance apparatus. Additionally, because a vertical cross-section area of the body 10 is decreased, underwater resistance is also decreased. The swimming assistance apparatus illustrated in FIG. 7 is depressed from the upper side to the lower side of the body 10 and a cut part is formed at the upper side of the fitting hole 20.

Figure 8:
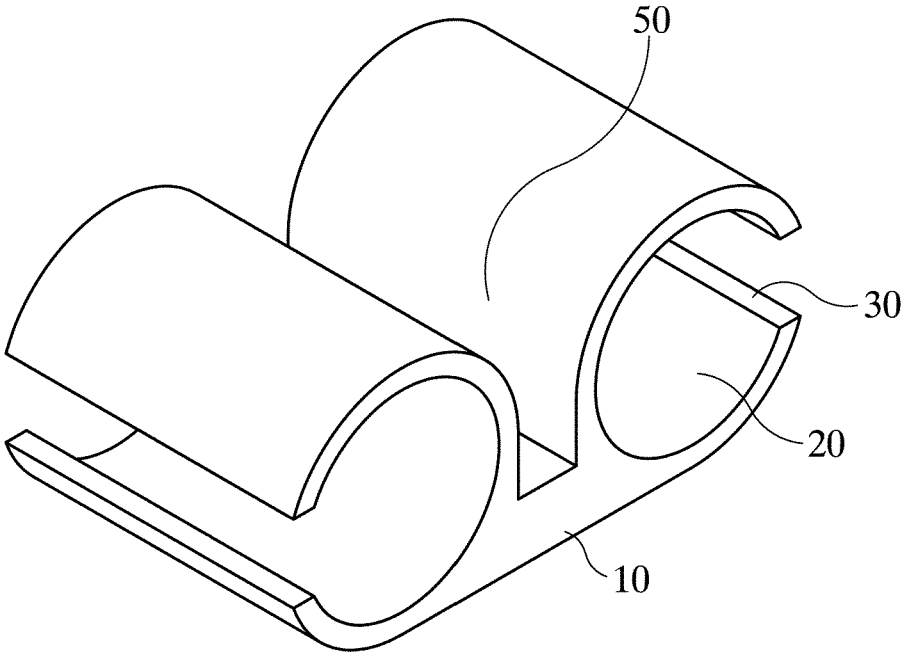
FIG. 8 is a perspective view of a swimming assistance apparatus according to a first modification of the fifth embodiment of the present invention.

In relation with a first modification of the fifth embodiment, FIG. 8 is a perspective view of a swimming assistance apparatus according to a first modification of the fifth embodiment of the present invention. The swimming assistance apparatus according to the first modification of the fifth embodiment of the present invention may include a depressed part 50 which is depressed from the upper side to the lower side of the body 10 and the cut parts 30 which are respectively formed at right and left sides of fitting holes 20. According to the first modification of the fifth embodiment of the present invention, the swimming assistance apparatus can obtain an effect by the depressed part 50 and effects created by the cut parts 30 formed at the right and left sides of the fitting holes 20.

Figure 9:
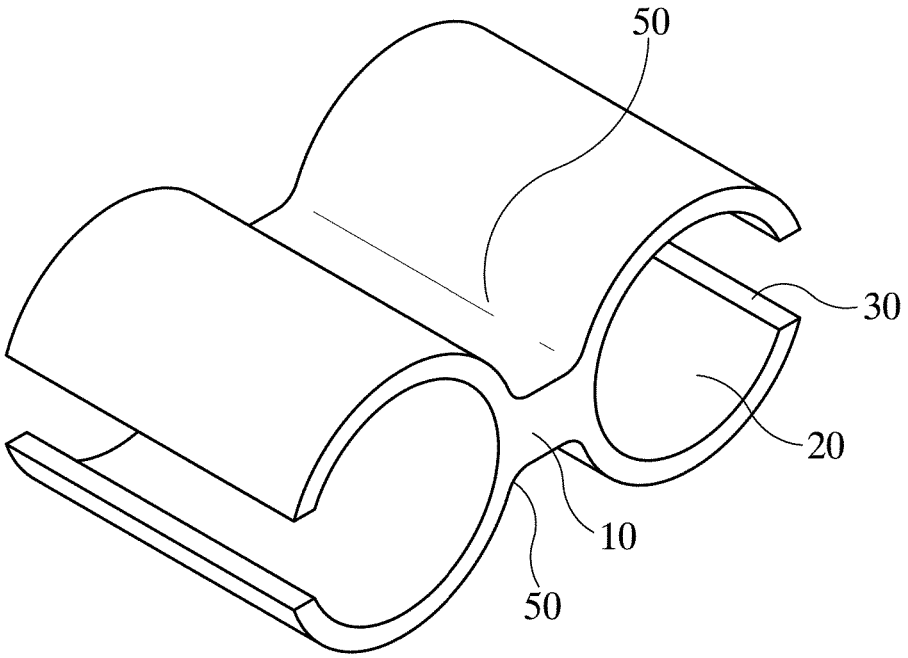
FIG. 9 is a perspective view of a swimming assistance apparatus according to a second modification of the fifth embodiment of the present invention.

In relation with a second modification of the fifth embodiment of the present invention, FIG. 9 is a perspective view of a swimming assistance apparatus according to the second modification of the fifth embodiment of the present invention.

The swimming assistance apparatus according to the second modification of the fifth embodiment of the present invention may include depressed parts 50 which is depressed from the upper and lower sides of the body 10 toward the inside of the body 10 and cut parts 30 which are respectively formed at right and left sides of fitting holes 20. According to the second modification of the fifth embodiment of the present invention, the swimming assistance apparatus can carry out as a pull buoy for swimming training which is called a 'peanut' or a 'peanut helper'.

In a case that the user wants to train the upper body or correct the swimming posture, the swimming assistance apparatus according to the second modification of the fifth embodiment of the present invention is fit between the knees or the thighs and inwardly presses the user's lower body to serve as the pull buoy. In a case that the user wants to do aquarobics, the swimming assistance apparatus according to the second modification of the fifth embodiment of the present invention serves as the pull buoy when the user insert the ankles into the depressed parts 50 to press the user's lower body, when the user uses the swimming assistance apparatus while grasping the depressed parts 50 with both hands, or when the user fits the swimming assistance apparatus under the user's arm in such a manner that the user's upper arms and the sides of the chest are inserted into the depressed parts 50. The user can selectively use the general function of the swimming assistance apparatus and the pull buoy function according to the second modification of the fifth embodiment as described above.

Figure 10:
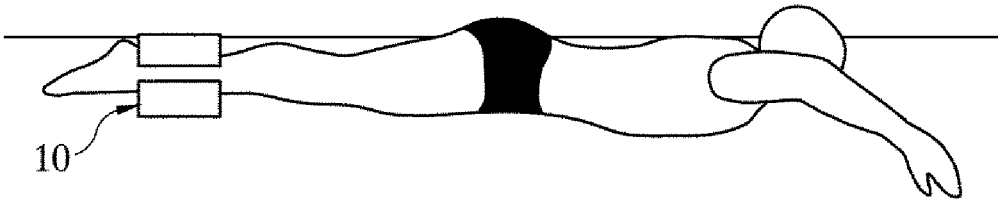
FIGS. 10 to 12 are side views and a plan view showing used states of the swimming assistance apparatus according to the second modification of the fifth embodiment of the present invention.
Figure 11:
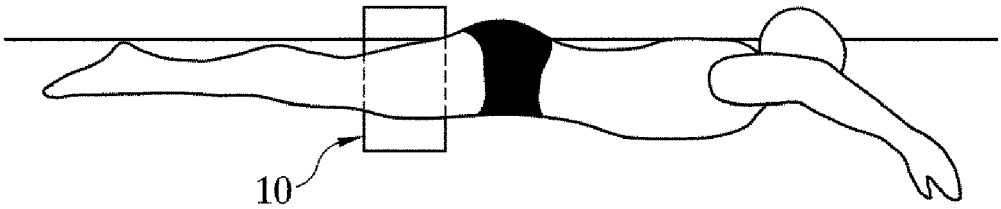
Figure 12:
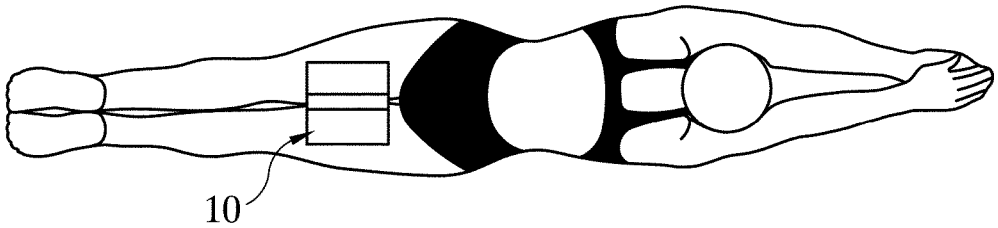

FIGS. 10 to 12 are side views and a plan view showing used states of the swimming assistance apparatus according to the second modification of the fifth embodiment of the present invention. The swimming assistance apparatus according to the second modification of the fifth embodiment of the present invention can be used in the first used state illustrated in FIG. 10 or in the second used state illustrated in FIGS. 11 and 12.

In the first used state of the second modification of the fifth embodiment illustrated in FIG. 10, like the first embodiment, the user wears the swimming assistance apparatus by inserting the user's legs into the fitting holes through the cut parts formed at the sides of the body 10 of the swimming assistance apparatus. By the swimming assistance apparatus according to the second modification of the fifth embodiment, the user's legs are collected and fixed.

In the second used state of the second modification of the fifth embodiment illustrated in FIGS. 11 and 12, the user wears the swimming assistance apparatus according to the second modification of the fifth embodiment between the knees and the thighs by fitting the knees or thighs on the depressed parts 50, and strongly presses the swimming assistance apparatus toward the inside of the user's lower body.

Embodiment 6

Figure 13:
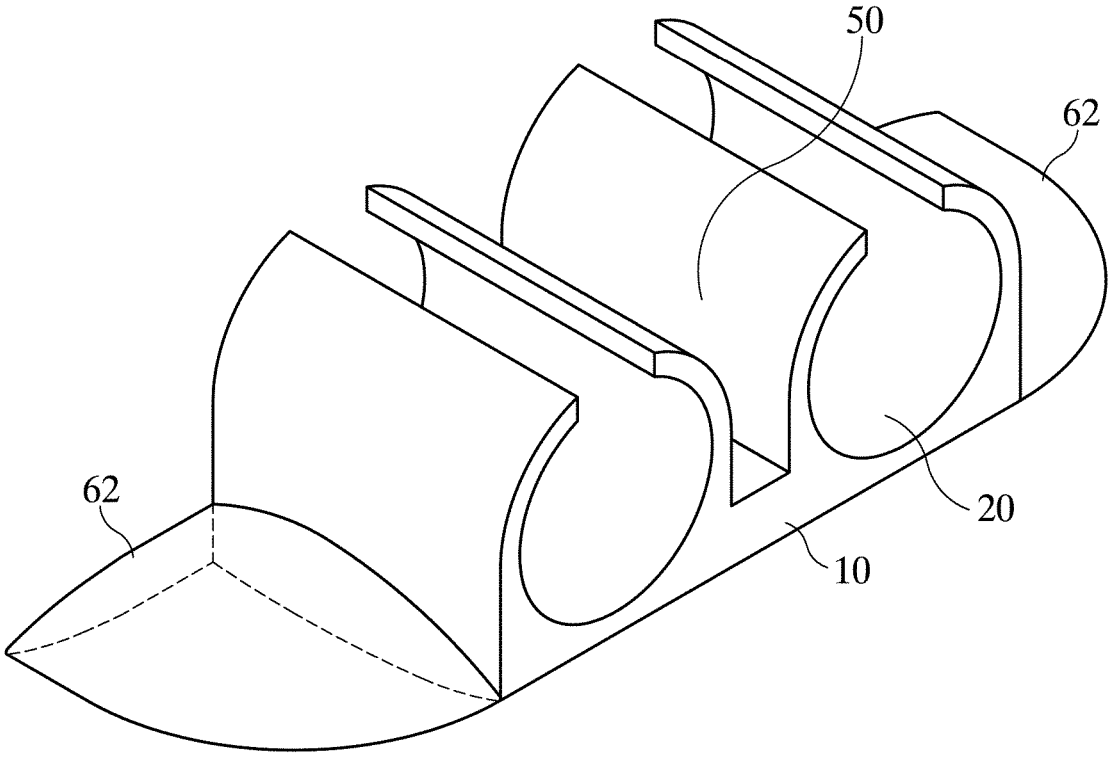
FIG. 13 is a perspective view of a swimming assistance apparatus according to a sixth embodiment of the present invention.

In relation with the sixth embodiment, FIG. 13 is a perspective view of a swimming assistance apparatus according to the sixth embodiment of the present invention. As shown in FIG. 13, the swimming assistance apparatus according to the sixth embodiment of the present invention may include wings 62 disposed at right and left sides of the body 10. The wings 62 are formed in a shape of a plate which becomes gradually narrowed in width when they become further from the body 10. The wings 62 may have a streamlined shape, namely, an oval cross section, to reduce underwater resistance in front of the swimming assistance apparatus. The wings 62 are formed outside the body 10 in the lateral direction, and the longitudinal direction of the body 10 and the plane of the wing are generally parallel.

The swimming assistance apparatus having the wings 62 according to the sixth embodiment of the present invention may be a form that two fitting holes 20 are formed in the board, which is one of the conventional swimming assistance apparatuses. The swimming assistance apparatus having the wings 62 is increased in volume occupying underwater and increases buoyancy by the wings 62. Moreover, the swimming assistance apparatus having the wings 62 increases power to overcome surface tension of the surface of the water because a contact area between the swimming assistance apparatus and the surface of water is widened. That is, because underwater resistance is increased vertically, the user's legs float well on water. Finally, the wings 62 have an effect to provide the swimming beginners with more buoyancy. Furthermore, the wings 62 prevent the swimming assistance apparatus from rotating around the progress direction under water.

Embodiment 7

Figure 14:
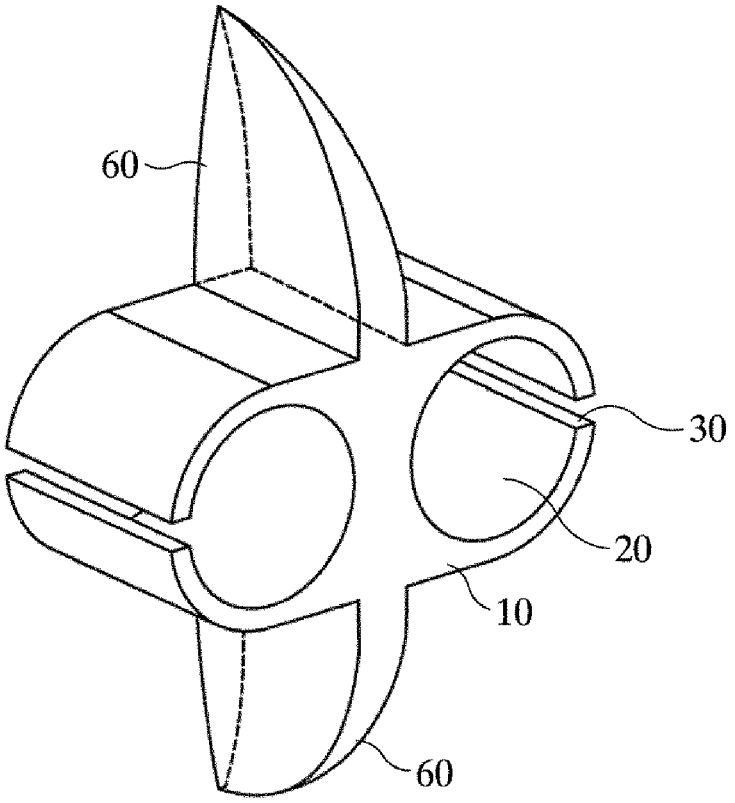
FIG. 14 is a perspective view of a swimming assistance apparatus according to a seventh embodiment of the present invention.

In relation with the seventh embodiment of the present invention, FIG. 14 is a perspective view of a swimming assistance apparatus according to the seventh embodiment of the present invention. As shown in FIG. 14, the swimming assistance apparatus according to the seventh embodiment of the present invention may include fins 60 which are formed in a shape of a plate which becomes gradually narrowed in width when they become further from the body 10. The fins 60 may have a streamlined shape, namely, an oval cross section, to reduce underwater resistance in front of the swimming assistance apparatus. The fins 60 are formed outside the body 10 in the vertical direction of the body 10, and the longitudinal direction of the body 10 and the normal line direction of the plane of the fin 60 are generally parallel.

The swimming assistance apparatus having the fins 60 according to the seventh embodiment of the present invention enhances the user's propulsive force because the fins 60 push out water when the user swims while moving the waist from side to side. Finally, when the user uses the swimming assistance apparatus having the fins 60, it increases exercise effect. Additionally, the fins 60 serve to keep the balance of the swimming assistance apparatus so as to prevent the swimming assistance apparatus from rotating around the progress direction under water.

Figure 15:
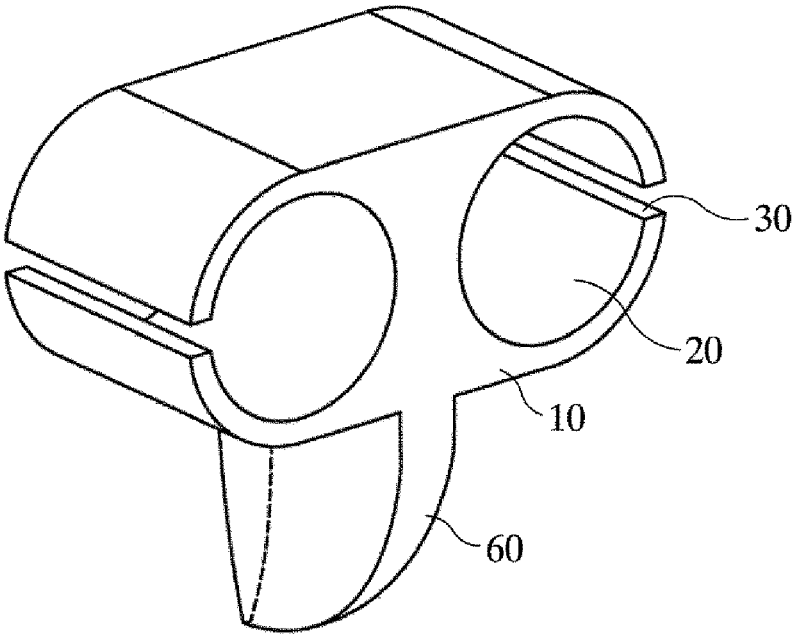
FIG. 15 is a perspective view of a swimming assistance apparatus according to a modification of the seventh embodiment of the present invention.

FIG. 15 is a perspective view of a swimming assistance apparatus according to a modification of the seventh embodiment of the present invention. As shown in FIG. 15, the swimming assistance apparatus according to the modification of the seventh embodiment of the present invention may include a fin 60 which is formed at one side of the upper and lower sides of the body 10.

Embodiment 8

Figure 16:
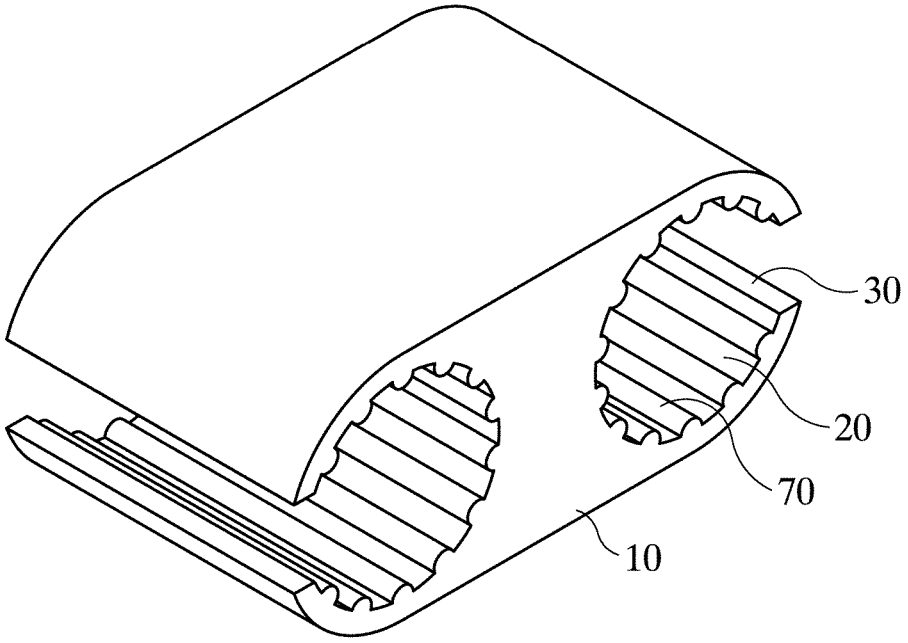
FIG. 16 is a perspective view of a swimming assistance apparatus according to an eighth embodiment of the present invention.
Figure 17:
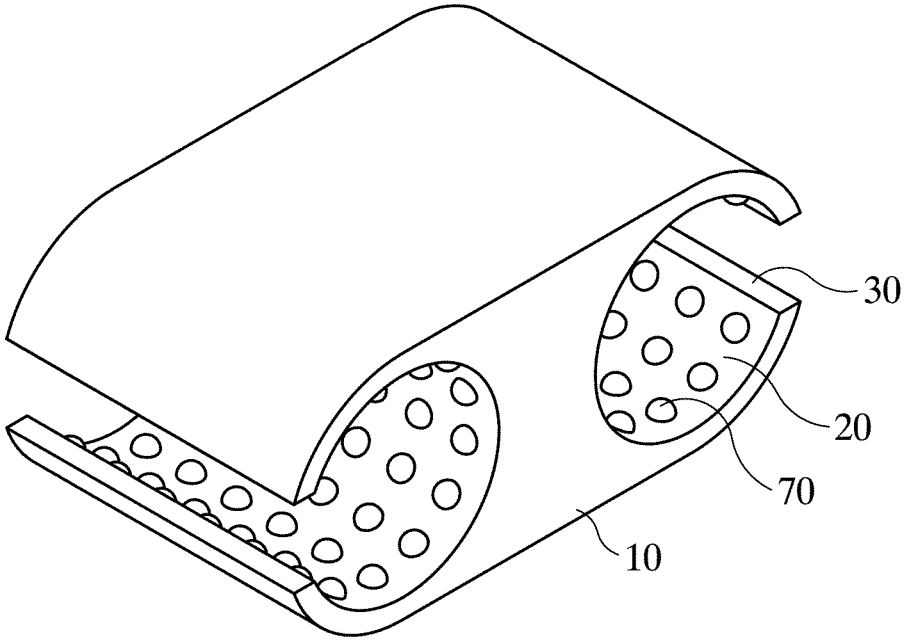
FIG. 17 is a perspective view of a swimming assistance apparatus according to a modification of the eighth embodiment of the present invention.

In relation with the eighth embodiment of the present invention, FIG. 16 is a perspective view of a swimming assistance apparatus according to the eighth embodiment of the present invention and FIG. 17 is a perspective view of a swimming assistance apparatus according to a modification of the eighth embodiment of the present invention. As shown in FIGS. 16 and 17, the swimming assistance apparatus according to the eighth embodiment of the present invention may include a protrusion part 70 which protrudes inwardly from at least a part of the inner face of the fitting hole 20. The protrusion part 70 may be in a straight line form as shown in FIG. 16 or in a semi-spherical form as shown in FIG. 17 showing the modification of the eighth embodiment. Additionally, the protrusion part 70 may has a spiral shape like a screw thread in order to increase grounding power with the user's legs in the back and forth direction of the swimming assistance apparatus.

According to the eighth embodiment of the present invention, the swimming assistance apparatus having the protrusion part 70 reinforces grounding power between the inside of the fitting holes 20 and the user's legs.

Embodiment 9

Figure 18:
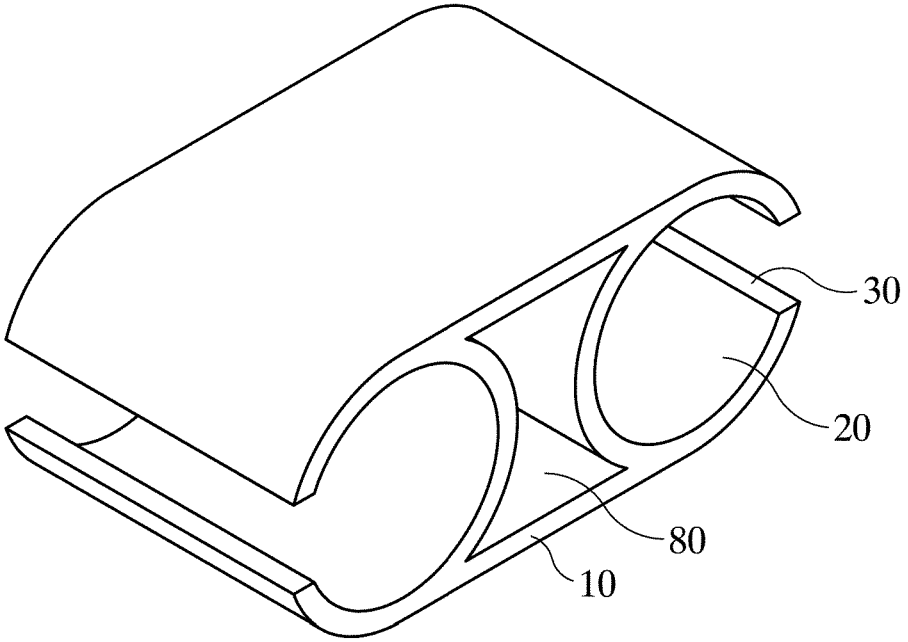
FIG. 18 is a perspective view of a swimming assistance apparatus according to a ninth embodiment of the present invention.

In relation with the ninth embodiment of the present invention, FIG. 18 is a perspective view of a swimming assistance apparatus according to the ninth embodiment of the present invention. As shown in FIG. 18, the swimming assistance apparatus according to the ninth embodiment of the present invention may include a through hole which is formed in the middle of the body 10 and penetrates through the swimming assistance apparatus in the back and forth direction. The cross section form of the through hole 80 may be one of a circle, a polygon, an oval and so on. Moreover, as shown in FIG. 18, a wall of uniform thickness is formed on the outside of the fitting holes 20, and the through hole 80 may have a rectangular cross section of which the middle part is concave to secure the maximum cross section area of the hole.

According to the ninth embodiment of the present invention, the swimming assistance apparatus having the through hole 80 can reduce underwater resistance and manufacturing costs.

Embodiment 10

Figure 19:
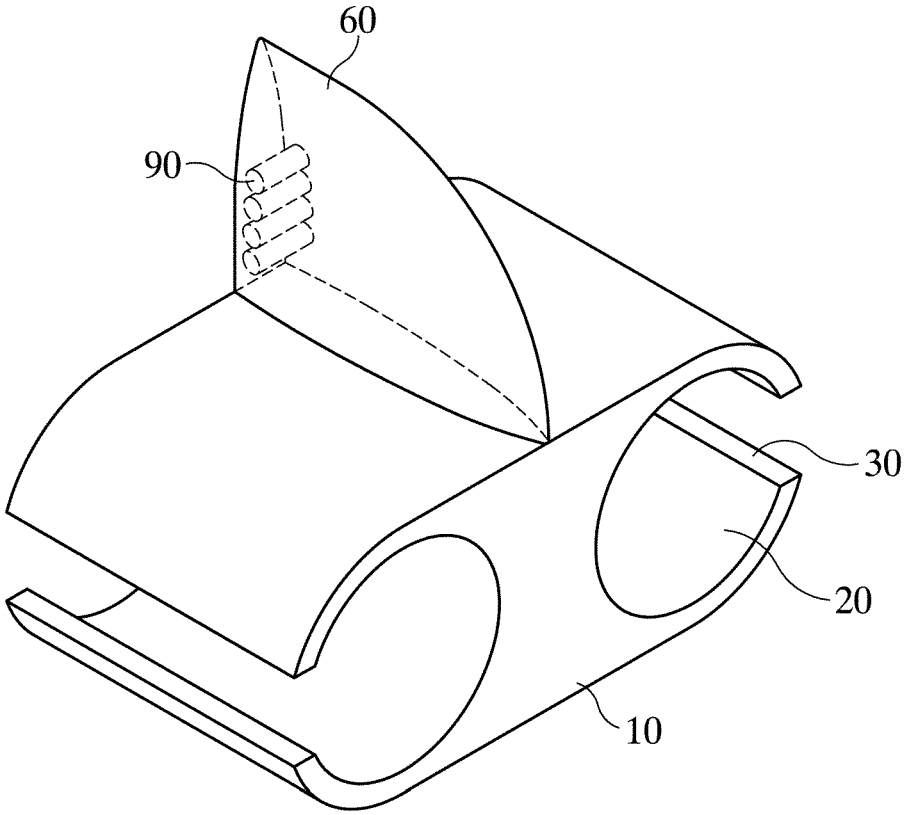
FIG. 19 is a perspective view of a swimming assistance apparatus according to a tenth embodiment of the present invention.

In relation with the tenth embodiment of the present invention, FIG. 19 is a perspective view of a swimming assistance apparatus according to the tenth embodiment of the present invention. As shown in FIG. 19, the swimming assistance apparatus according to the tenth embodiment of the present invention may include a fin 60 which is vertically formed at right angles to the body 10 and formed outside the central portion of the body 10 and a plurality of hand-grips 90 of a hole form which penetrate the fin 60 in the width direction. One to five hand-grips 90 may be formed in such a manner that the user can insert each finger into each hand-grip or the plural fingers into one hand-grip. According to a modification of the tenth embodiment of the present invention, the hand-grip 90 may be formed in the body 10 or in one side of the wing 62. According to the tenth embodiment of the present invention, the swimming assistance apparatus having the hand-grip 90 enables the user to easily grasp the swimming assistance apparatus.

Embodiment 11

Figure 20:
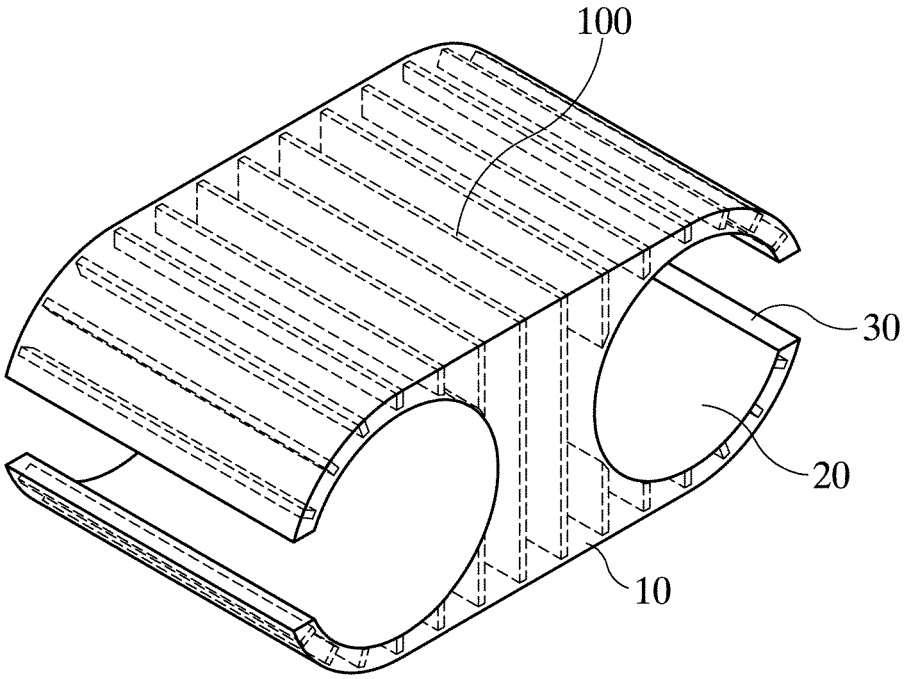
FIG. 20 is a perspective view of a swimming assistance apparatus according to an eleventh embodiment of the present invention.
Figure 21:
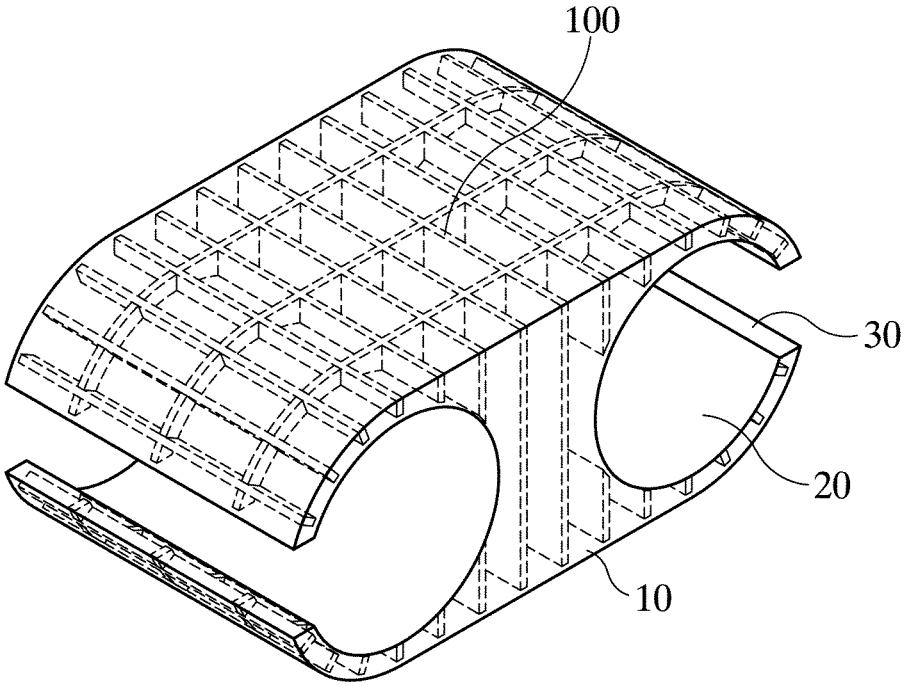
FIG. 21 is a perspective view of a swimming assistance apparatus according to a first modification of the eleventh embodiment of the present invention.
Figure 22:
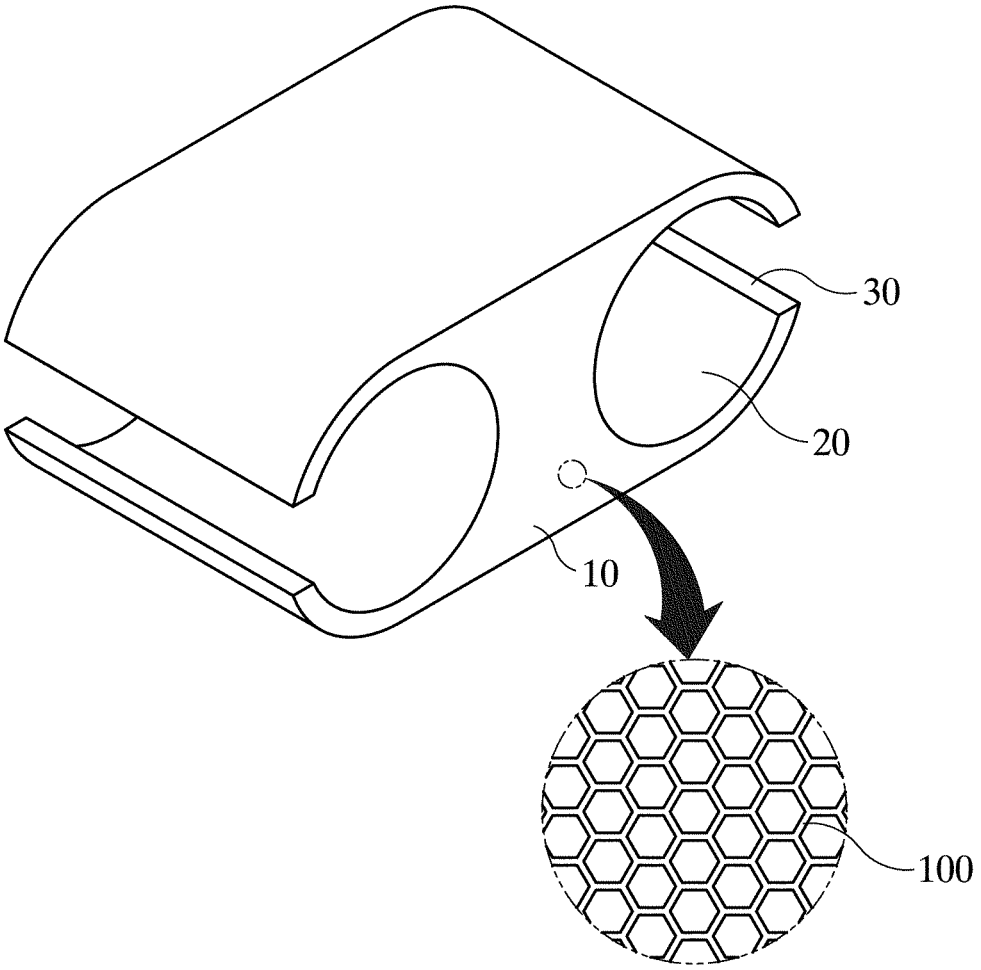
FIG. 22 is a perspective view of a swimming assistance apparatus according to a second modification of the eleventh embodiment of the present invention.

In relation with the eleventh embodiment of the present invention, FIG. 20 is a perspective view of a swimming assistance apparatus according to the eleventh embodiment of the present invention, FIG. 21 is a perspective view of a swimming assistance apparatus according to a first modification of the eleventh embodiment of the present invention, and FIG. 22 is a perspective view of a swimming assistance apparatus according to a second modification of the eleventh embodiment of the present invention. As shown in FIGS. 20, 21 and 22, the swimming assistance apparatus according to the eleventh embodiment of the present invention may be formed in a hollow tube type and include partition walls 100 formed inside the body 10 to increase the general strength of the swimming assistance apparatus. The partition walls 100 may be in a flat form as shown in FIG. 20, in a crisscross form as shown in FIG. 21, or in a honeycomb form as shown in FIG. 22.

The swimming assistance apparatus having the partition walls 100 according to the eleventh embodiment of the present invention reduces manufacturing costs and reinforces buoyancy because the inside of the swimming assistance apparatus is generally hollow. Furthermore, swimming assistance apparatus having the partition walls 100 of the crisscross form as shown in FIG. 21 prevents distortion of the swimming assistance apparatus because it increases strength of the swimming assistance apparatus in all directions. In addition, swimming assistance apparatus having the partition walls 100 of the honeycomb form as shown in FIG. 22 increases strength of the swimming assistance apparatus the most.

Embodiment 12

Figure 23:
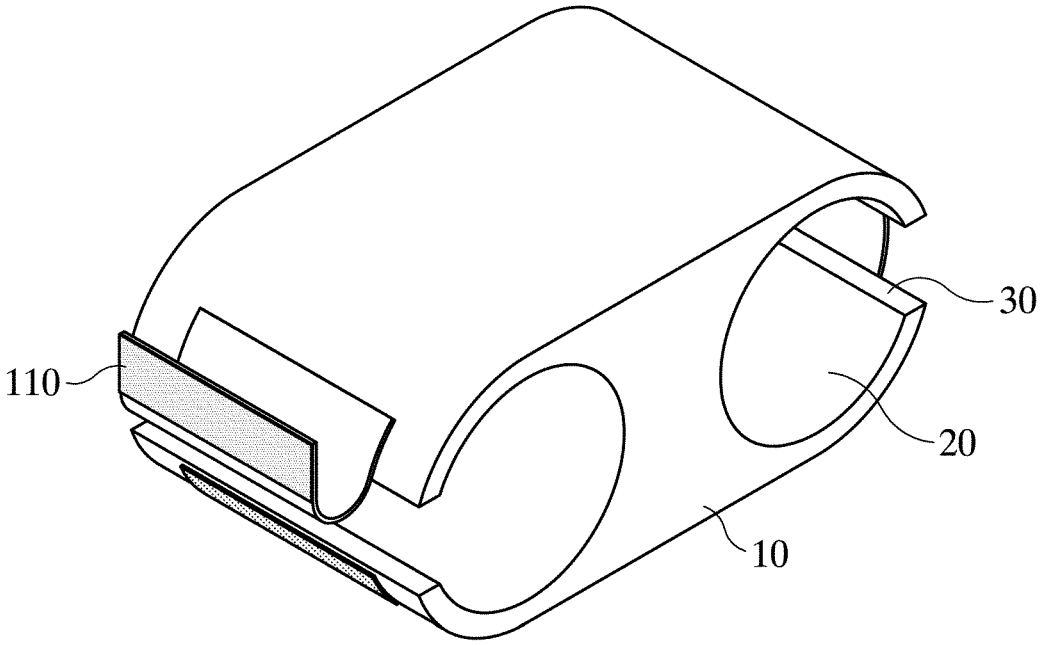
FIG. 23 is a perspective view of a swimming assistance apparatus according to a twelfth embodiment of the present invention.
Figure 24:
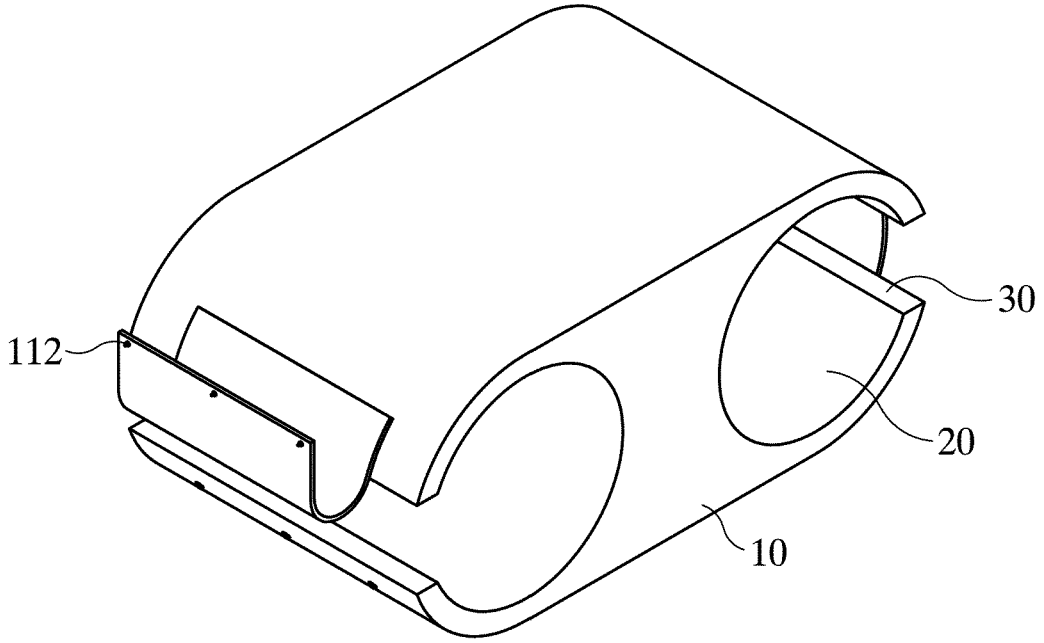
FIG. 24 is a perspective view of a swimming assistance apparatus according to a first modification of the twelfth embodiment of the present invention.
Figure 25:
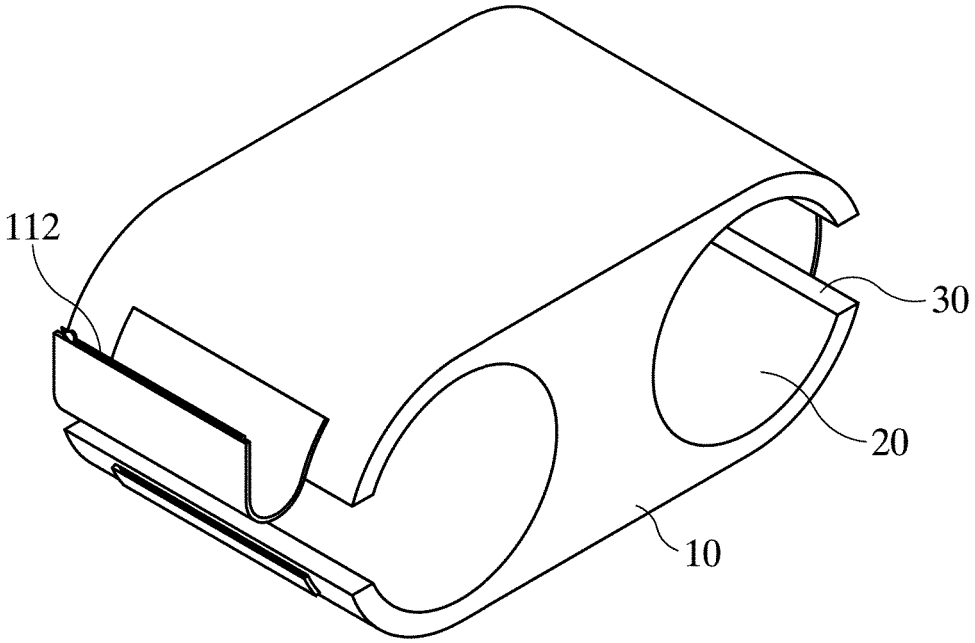
FIG. 25 is a perspective view of a swimming assistance apparatus according to a second modification of the twelfth embodiment of the present invention.

In relation with the twelfth embodiment of the present invention, FIG. 23 is a perspective view of a swimming assistance apparatus according to the twelfth embodiment of the present invention, FIG. 24 is a perspective view of a swimming assistance apparatus according to a first modification of the twelfth embodiment of the present invention, and FIG. 25 is a perspective view of a swimming assistance apparatus according to a second modification of the twelfth embodiment of the present invention. As shown in FIGS. 23, 24 and 25, the swimming assistance apparatus according to the twelfth embodiment of the present invention may include separation preventing means to close at least a part of the cut part 30 according to the user's selection. The separation preventing means may be a hook and loop fasteners 110 as shown in FIG. 23, may be male and female coupling means, such as a button 112 as shown in FIG. 24, or may be a zipper 114 as shown in FIG. 25. In the first modification of the twelfth embodiment illustrated in FIG. 24, as detachable fixing means of the separation preventing means, a magnet may be used.

The magnet makes use of the separation preventing means easy.

The swimming assistance apparatus having the separation preventing means according to the twelfth embodiment of the present invention can have an effect to fix the swimming assistance apparatus to the user's legs according to the user's selection. The swimming assistance apparatus having the separation preventing means can be used usefully to the persons who have disability in the lower body, such as paraplegia, because it prevents the user's legs from being separated from the fitting holes 20.

Embodiment 13

Figure 26:
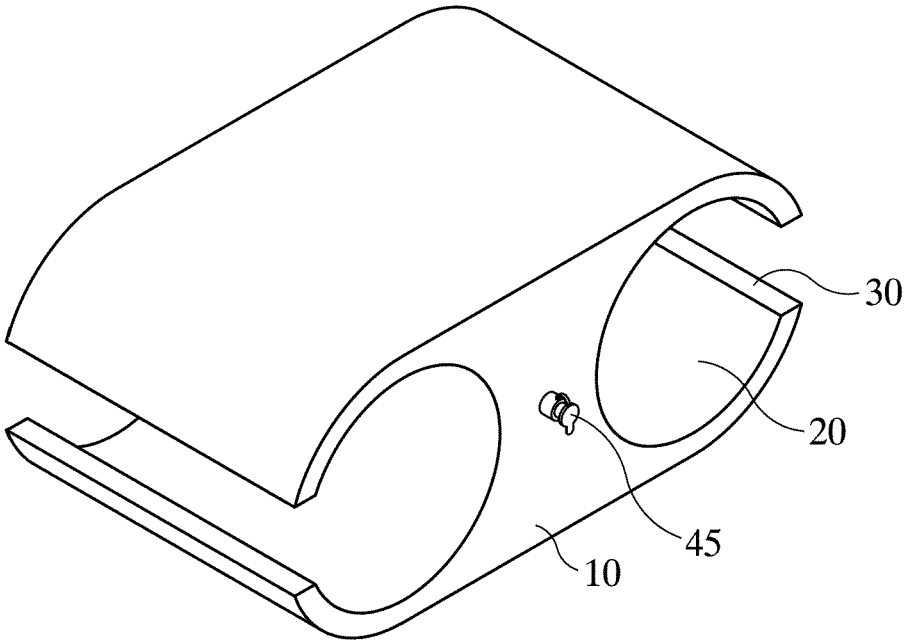
FIG. 26 is a perspective view of a swimming assistance apparatus according to the thirteenth embodiment of the present invention.

In relation with the thirteenth embodiment of the present invention, FIG. 26 is a perspective view of a swimming assistance apparatus according to the thirteenth embodiment of the present invention. As shown in FIG. 26, the swimming assistance apparatus according to the thirteenth embodiment of the present invention may be formed in a hollow tube type and include an air injection hole 45 for injecting air into the swimming assistance apparatus. In order to minimize underwater friction, the air injection hole 45 is formed on the front face of the body 10. The swimming assistance apparatus according to the thirteenth embodiment of the present invention can compress the swimming assistance apparatus to the minimum volume to be stored and carried easily by discharging the air, which fills the inside the swimming assistance apparatus, out of the air injection hole 45.

Embodiment 14

Figure 27:
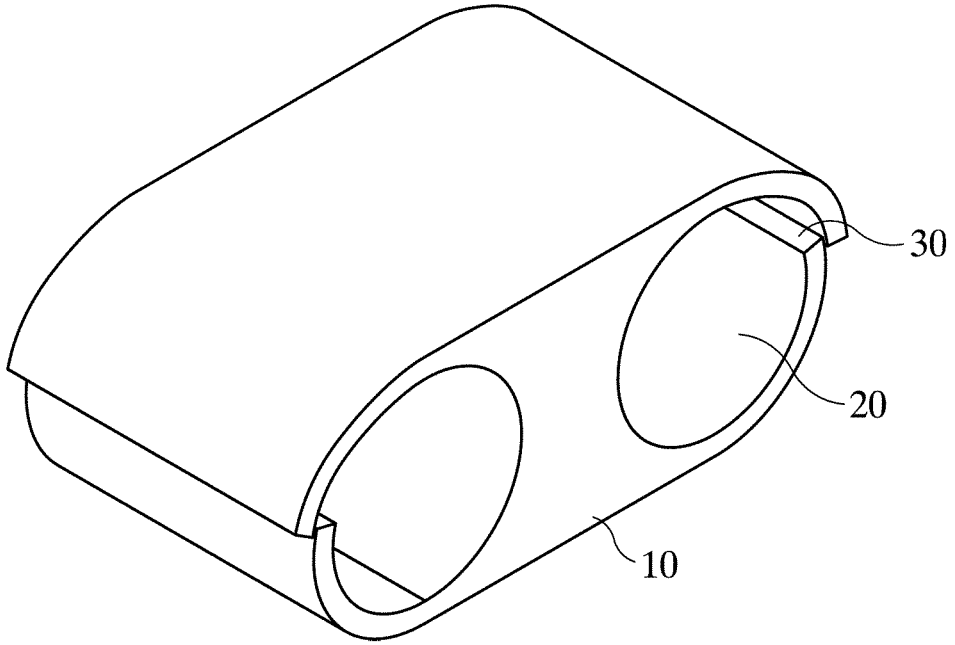
FIG. 27 is a perspective view of a swimming assistance apparatus according to the fourteenth embodiment of the present invention.

In relation with the fourteenth embodiment of the present invention, FIG. 27 is a perspective view of a swimming assistance apparatus according to the fourteenth embodiment of the present invention. As shown in FIG. 27, the swimming assistance apparatus according to the fourteenth embodiment of the present invention may include the fitting holes 20 having outer walls which are dislocated at the cut parts 30. The swimming assistance apparatus having the outer walls of the fitting holes 20 which are dislocated at the cut parts 30 makes the user easily insert the legs into the fitting holes and makes the swimming assistance apparatus be fixed to the user's legs more stably. Preferably, the dislocated size of the outer walls of the fitting holes 20 at the cutting parts 30 is 0.5 cm to 3 cm, and more preferably, is 1 cm. If the dislocated size of the outer walls of the fitting holes 20 at the cutting parts 30 becomes larger, the swimming assistance apparatus is fixed to the user's legs more stably. However, if the dislocated size of the outer walls of the fitting holes 20 at the cutting parts 30 becomes smaller, the user's legs are inserted into the fitting holes 20 more easily.

Used States of Swimming Assistance Apparatus

Figure 28:
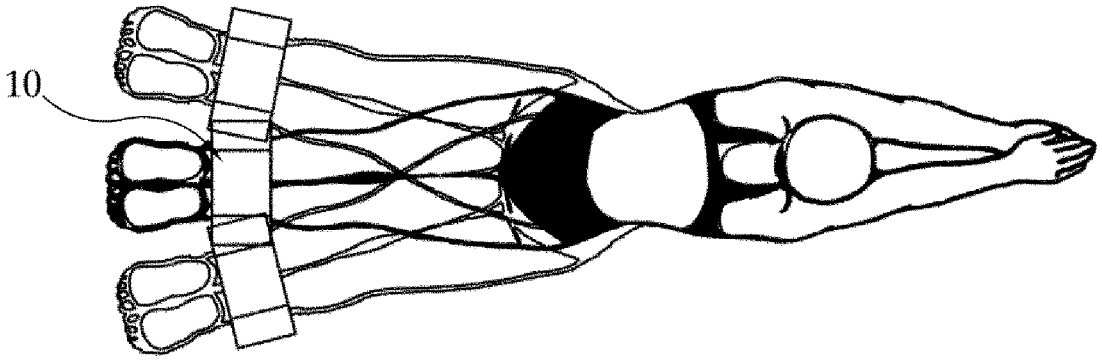
FIGS. 28 and 29 are a side view and a plan view showing a used state of the swimming assistance apparatus according to one embodiment of the present invention.
Figure 29:
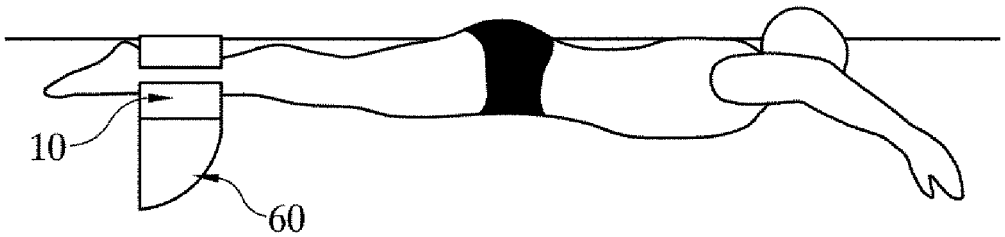

In relation with used states of the swimming assistance apparatus, FIGS. 28 and 29 are a side view and a plan view showing a used state of the swimming assistance apparatus according to the embodiment of the present invention. As shown in FIGS. 28 and 29, the swimming assistance apparatus according to the embodiment of the present invention is worn to the user's legs when the user inserts the user's legs into the fitting holes through the cut parts of the sides of the body 10 of the swimming assistance apparatus. By the swimming assistance apparatus, the user's legs are gathered and fixed. The user can wear the swimming assistance apparatus onto the calves, knees or thighs, and more preferably, onto the ankles. Moreover, the swimming assistance apparatus having the fins 60 as shown in FIGS. 14 and 15 can be used.

The user can train various swimming styles while moving the waist from side to side or swinging the arms in the state where the user's legs are fixed using the swimming assistance apparatus. The user's lower body floats on water by buoyancy of the swimming assistance apparatus. Therefore, the user can perform various swimming styles without taking care about the lower body. The user can move forward in a good swimming style while moving the waist from side to side like a fish which swims using the caudal fin. Therefore, the user can reinforce upper body muscles and waist muscles and correct the user's twisted pelvises.

Because the user can swim while moving only the upper body using the swimming assistance apparatus according to the embodiment of the present invention without whip kick, the persons who have disability in the lower body, children or the aged who are weak in strength of the lower body can swim using the swimming assistance apparatus.

Especially, the persons who have disability in the lower body can use the swimming assistance apparatus for medical purposes, such as pain relief or treatment. The persons who have disability in the lower body, such as paraplegia, cannot swim while doing whip kick or moving the waist up and down, and they go under water with the legs drifted open when they enter the water. Therefore, when the persons who have disability in the lower body uses the swimming assistance apparatus according to the embodiment of the present invention, it can help in treating pains because a physical therapist can keep eye contact with the patients and communion between the physical therapist and the patients is increased.

As described above, while the present invention has been particularly shown and described with reference to the example embodiments thereof, it will be understood by those of ordinary skill in the art that the present invention can be executed in other forms without changing the technical idea or essential features of the present invention. Therefore, it would be understood that the embodiments disclosed in the present invention are all exemplified and are not limited to the specific embodiments of the present invention. It should be also understood that the protective scope of the present invention is interpreted by the following claims and all changes and modifications derived from the meaning, scope and equivalent concept of the claims belong to the technical scope of the present invention.

The invention claimed is:

1. A swimming assistance apparatus comprising:

a body part made of a floatable material or having a hollow tube which floats on water;

a fitting hole having a hollow cylinder shape and defined through the body part to surround a first part of a user's lower body;

a cut part defined on at least one side of a wall of the fitting hole and having a slot receiving the first part of the user's lower body into the fitting hole; and a depressed part defined on upper and lower sides of the body part, wherein:

the fitting hole comprises a first fitting hole and a second fitting hole and the user can insert the right and left legs into the first and second fitting holes respectively, the depressed part defined between the first fitting hole and the second fitting hole of the body part, having a predetermined depth such that a second part of the user's lower body is pressed toward or fixed on the depressed part, the second part comprising at least a portion of knees, thighs, or parts between the knees and thighs, and when the user swims with the swimming assistance apparatus and when the first part of the user's lower body is inserted into the fitting hole, the user's lower body floats on water by buoyancy of the body part and underwater resistance is decreased by the depressed part.

2. The swimming assistance apparatus as claimed in claim 1, wherein the depressed part is extended in a longitudinal direction of the fitting hole.

3. The swimming assistance apparatus as claimed in claim 1, wherein the cut part is defined in the outer wall of the fitting hole in the longitudinal direction of the fitting hole to enable the user to easily insert the user's lower body.

4. The swimming assistance apparatus as claimed in claim 1, wherein at least a part of an area between the cut part and the depressed part has an arc shape in cross-section.

5. The swimming assistance apparatus as claimed in claim 1, wherein:

the depressed part is extended in a longitudinal direction of the fitting hole, and at least a part of an area between the cut part and the depressed part has an arc shape in cross-section.

6. The swimming assistance apparatus as claimed in claim 1, further comprising:

a plurality of protrusion parts which are disposed on an inner face of the fitting hole in a diameter direction.

7. The swimming assistance apparatus as claimed in claim 1, further comprising:

a plurality of protrusion parts disposed on an inner face of the fitting hole in a diameter direction and are protruded in a spherical shape.

8. The swimming assistance apparatus as claimed in claim 1, further comprising:

a plurality of protrusion parts disposed on an inner face of the fitting hole in a diameter direction and are formed in a spiral shape.

9. The swimming assistance apparatus as claimed in claim 1, further comprising:

a partition wall defined inside the body part maintaining a structure of the body and resisting a distortion of the body part.

10. The swimming assistance apparatus as claimed in claim 1, further comprising:

a plurality of partition walls defined inside the body part maintaining a structure of the body and resisting a distortion of the body part, wherein the plurality of partition walls cross each other.

11. The swimming assistance apparatus as claimed in claim 1, further comprising:

a plurality of partition walls defined inside the body part maintaining a structure of the body and resisting a distortion of the body part, wherein the plurality of partition walls are connected with one another in a honey comb shape.

12. The swimming assistance apparatus as claimed in claim 1, further comprising:

at least one through hole formed at the body part.

13. The swimming assistance apparatus as claimed in claim 1, further comprising:

a through hole penetrating through the body part and disposed between the first fitting hole and the second fitting hole wherein all of the first fitting hole, the second fitting hole and the though hole are extended in a longitudinal direction.

14. The swimming assistance apparatus as claimed in claim 1, further comprising:

at least one hand-grip having a concave portion in one side of the body part or having a penetration-hole in the body part, such that the user can insert at least one finger into the hand-grip to grasp the body part.

15. The swimming assistance apparatus as claimed in claim 1, further comprising:

at least one fin vertically protruded from at least one of an upper side and a lower side of the body part and extended along with a center line either of the upper side or the lower side of the body part in a longitudinal direction.

16. The swimming assistance apparatus as claimed in claim 15, wherein the fin has a predetermined curvature at the front face, which is the user's advancing direction, in order to reduce underwater resistance.

17. The swimming assistance apparatus as claimed in claim 1, wherein:

the swimming assistance apparatus is formed in a hollow tube type, and the swimming assistance apparatus further comprises an air injection hole for injecting air into the swimming assistance apparatus.

18. The swimming assistance apparatus as claimed in claim 1, wherein the first part of the user's lower body comprises at least a portion of ankles, the knees, or parts between the ankles and knees.

* * * * *